US010913576B2

(12) United States Patent
Crisp

(10) Patent No.: US 10,913,576 B2
(45) Date of Patent: Feb. 9, 2021

(54) TAMPER EVIDENT LOCKING DEVICE

(71) Applicant: E.J. BROOKS COMPANY, Angola, IN (US)

(72) Inventor: David Crisp, London (GB)

(73) Assignee: E.J. BROOKS COMPANY, Angola, IN (US)

( * ) Notice: Subject to any disclaimer, the term of this patent is extended or adjusted under 35 U.S.C. 154(b) by 492 days.

(21) Appl. No.: 15/828,501

(22) Filed: Dec. 1, 2017

(65) Prior Publication Data

US 2018/0155083 A1 Jun. 7, 2018

Related U.S. Application Data

(60) Provisional application No. 62/429,204, filed on Dec. 2, 2016.

(51) Int. Cl.
*B65D 27/30* (2006.01)
*G09F 3/03* (2006.01)
(Continued)

(52) U.S. Cl.
CPC ..... *B65D 27/30* (2013.01); *B65D 55/14* (2013.01); *G09F 3/0292* (2013.01);
(Continued)

(58) Field of Classification Search
CPC ..... Y10T 292/48; Y10T 292/491; Y10T 292/492; Y10T 292/494; Y10T 292/495;
(Continued)

(56) References Cited

U.S. PATENT DOCUMENTS 98,917 A * 1/1870 Brooks ..... E05B 39/02 70/50
344,049 A * 6/1886 Kirby ..... E05B 17/2023 292/329

(Continued)

FOREIGN PATENT DOCUMENTS

CN 202509902 10/2012
CN 203531545 U 4/2014

(Continued)

OTHER PUBLICATIONS

International Search Report and Written Opinion dated Mar. 6, 2018, from corresponding PCT application No. PCT/IB2017/057573.

(Continued)

*Primary Examiner* — Carlos Lugo
(74) *Attorney, Agent, or Firm* — Honigman LLP

(57) ABSTRACT

A locking device includes a lock body, a hasp and a seal. The lock body includes a hasp locking latch pivotally disposed therein and a seal locking latch pivotally disposed therein. The hasp is disposed at the lock body and movable between an open state, where a free end of the hasp is external the lock body, and a closed state, where the free end of the hasp is within the lock body. The seal, when inserted into the lock body when the hasp is in its closed state, engages the hasp locking latch to pivot the hasp locking latch to engage and lock the hasp in its closed state, and the seal, when inserted into the lock body, engages the seal locking latch to lock the seal within the lock body. The seal includes a frangible portion that is configured to break the seal into first and second portions.

26 Claims, 11 Drawing Sheets

(51) Int. Cl.
*B65D 55/14* (2006.01)
*G09F 3/00* (2006.01)
*E05B 67/00* (2006.01)

(52) U.S. Cl.
CPC ..... *G09F 3/0305* (2013.01); *G09F 3/0347* (2013.01); *B65D 2401/00* (2020.05); *E05B 67/00* (2013.01); *Y10T 292/48* (2015.04)

(58) Field of Classification Search
CPC ..... Y10T 292/496; Y10T 292/498; Y10T 292/499; Y10T 292/509; Y10T 292/516
USPC ..... 70/38 B, 38 C, 50
See application file for complete search history.

(56) References Cited

U.S. PATENT DOCUMENTS 421,966 A * 2/1890 Peacock ..... E05B 67/24 70/38 B
549,951 A * 11/1895 Belanger ..... E05B 39/02 70/50
816,492 A * 3/1906 Mohr ..... E05B 67/10 70/46
1,948,255 A * 2/1934 Brooks ..... G09F 3/0358 292/328
2,160,294 A * 5/1939 Soref ..... E05B 67/22 70/38 B
2,683,979 A * 7/1954 Stageberg ..... A44B 15/00 70/459
3,591,223 A 7/1971 Castro Neto
3,770,307 A 11/1973 Van Gompel
3,984,081 A 10/1976 Hoganson
3,994,521 A 11/1976 Van Gompel
4,049,303 A 9/1977 Irwin et al.
4,057,982 A 11/1977 Drayton
4,074,916 A 2/1978 Schindler
4,141,117 A 2/1979 Van Gompel
4,216,568 A 8/1980 Anderson
4,280,726 A 7/1981 McCoag
4,342,477 A 8/1982 McClure
4,358,944 A 11/1982 Stoffel
4,416,478 A 11/1983 Canney
4,500,124 A 2/1985 Swift
4,512,599 A * 4/1985 De Lima Castro Netto ..... A44B 19/301 24/388
4,640,538 A 2/1987 Brammall
4,681,356 A 7/1987 Brammall
4,747,631 A 5/1988 Loynes et al.
4,775,175 A 10/1988 Swift
4,793,644 A 12/1988 Swift
4,883,295 A 11/1989 Kesselman
4,893,853 A 1/1990 Guiler
4,909,552 A 3/1990 Weber et al.
5,092,641 A 3/1992 Penick, Jr.
5,127,687 A 7/1992 Guiler
5,147,145 A 9/1992 Facey et al.
5,170,537 A 12/1992 Sperling
5,222,776 A 6/1993 Georgopoulos et al.
5,230,541 A * 7/1993 Nowak ..... E05C 19/18 24/16 PB
5,303,567 A * 4/1994 Nava ..... E05B 15/08 40/299.01
5,306,054 A 4/1994 Georgopoulos
5,352,003 A 10/1994 Bystry
5,359,870 A 11/1994 Ruetlinger
5,538,300 A 7/1996 Brown
5,582,447 A 12/1996 Leon et al.
5,611,583 A 3/1997 Bystry et al.
5,647,620 A 7/1997 Kuenzel
5,743,574 A 4/1998 Kohn
5,820,176 A 10/1998 Leon et al.
6,089,056 A 7/2000 Yoda et al.
6,131,969 A 10/2000 Natkins
6,155,617 A 12/2000 Kuenzel
6,199,413 B1 3/2001 McDaid et al.
6,345,847 B1 2/2002 Dreisbach et al.
6,360,411 B1 * 3/2002 Bortz ..... G09F 3/0311 24/704.2
6,398,273 B1 * 6/2002 Aichmann ..... G09F 3/0358 292/319
6,457,754 B1 10/2002 Bystry et al.
6,494,508 B1 12/2002 Dreisbach et al.
6,540,273 B2 4/2003 Brammall et al.
6,550,830 B2 4/2003 Kuenzel
6,578,886 B1 6/2003 Bystry et al.
6,578,887 B1 * 6/2003 Kienzler ..... G09F 3/0347 292/307 R
6,581,292 B2 6/2003 Allis
6,719,335 B2 4/2004 Velschou et al.
7,073,358 B1 7/2006 Lee
7,073,828 B2 7/2006 Foigel et al.
7,118,144 B2 * 10/2006 Anderson ..... E05B 39/02 292/307 R
7,278,665 B2 10/2007 Rogatnev
7,370,892 B2 * 5/2008 Collingham ..... G09F 3/0311 24/704.1
7,472,933 B2 1/2009 Weedon et al.
7,478,847 B2 1/2009 Kleynerman et al.
7,641,062 B2 1/2010 Arakawa
7,988,209 B2 * 8/2011 Hudson ..... G09F 3/0305 24/700
8,052,180 B1 * 11/2011 Lassen ..... B65D 90/22 292/307 A
8,327,674 B2 * 12/2012 Valerio ..... E05B 17/0062 70/21
9,558,682 B2 1/2017 Dreisbach et al.
9,688,440 B2 * 6/2017 Blonden ..... B65D 27/30
2005/0230981 A1 10/2005 Anderson et al.
2006/0117816 A1 6/2006 Lee
2006/0202489 A1 9/2006 Collingham et al.
2007/0262594 A1 11/2007 Hudson et al.
2011/0012377 A1 1/2011 Simes et al.
2013/0200637 A1 8/2013 Dreisbach et al.

FOREIGN PATENT DOCUMENTS

DE 20314436 11/2003
EP 1967759 9/2008
WO WO2015133886 9/2015

OTHER PUBLICATIONS

Extended European Search Report and Opinion dated May 18, 2020 from corresponding EP Application No. 17875767.0.

* cited by examiner

TAMPER EVIDENT LOCKING DEVICE

CROSS REFERENCE TO RELATED APPLICATION

The present application claims the filing benefits of U.S. provisional application Ser. No. 62/429,204, filed Dec. 2, 2016, which is hereby incorporated herein by reference in its entirety.

FIELD OF THE INVENTION

The present invention relates to locking devices or security seals for locking or sealing items, such as cargo containers or doors or the like, and, more particularly, to a security device that has a tamper evident feature.

BACKGROUND OF THE INVENTION

It is known in the art to provide a security seal or locking device for locking or sealing an item, such as cargo containers or doors or the like. The locking devices often include a flexible cable or bolt or the like extending from one end of a metallic or plastic locking body, where the cable or bolt or the like may be routed through an opening of the cargo container or door and received into another end of the locking body to substantially seal or secure the locking device to the cargo container or door.

An important feature of such devices is that they should show visible signs of attempts to gain access to the sealed item. Typically, there are two types of seals in general use for this purpose, tamper evident seals and barrier seals. Tamper evident seals perform a similar function to traditional wax seals used to seal confidential documents, as the seal has to be broken to gain access to the item, and once broken clearly shows that that the item is no longer secure. Barrier seals also provide visual evidence of tampering but also provide a degree of physical security, in some cases to a degree of security similar to that of a padlock.

A disadvantage of barrier seals when compared with tamper evident seals is cost. A tamper evident seal can be produced very cheaply and is often a single component plastic device such as a flexible strap with saw-tooth type projections along its length that is looped through the item to be sealed with the free end of the strap inserted into an integral receptacle that allows insertion but not withdrawal. A barrier seal is more expensive not only because of higher cost stronger materials, but also because of increased complexity and the associated increase in the number of components requiring factory assembly.

A typical design of a barrier seal employs a padlock type body incorporating a metal hasp to fasten and secure the item, but instead of a conventional locking mechanism released by a key, a disposable plastic seal incorporating flexible latches is inserted and trapped in the lock body to lock the mechanism that cannot be removed without destroying the seal, thus providing visual evidence of tampering. A disadvantage of this type of seal is the requirement of flexibility to allow the latch barbs to bend without breaking, and the need for the main portion of the seal to be brittle enough to break cleanly when attempts are made to remove it. Because of the requirement for flexibility, it is often easy for a thief to pry this type of seal out of the lock body and reinsert it again leaving little or no visual indication of tamper.

SUMMARY OF THE INVENTION

The present invention provides a security seal or locking device that has a lock body (such as a metallic lock body), which receives a locking element or hasp therein to secure the seal to a container or door, with an insertable and breakable and removable seal disposed in the lock body to secure the hasp at the lock body and thus to secure the locking device at the element or container or door to be locked or secured. The present invention provides a locking device that can be used to lock and secure containers, doors, boxes, document cases, wallets and the like, and in particular to airline in-flight cabin carts.

The locking device of the present invention provides a rigid lock body and hasp element, with a latch that engages and secures the hasp element in its closed position. A rigid frangible seal is inserted into the lock body to pivot and lock the latch into a locking position where it engages the hasp element to lock the locking device at a structure. The seal, when so inserted, is secured or locked in the lock body (via a spring loaded or biased latch) and cannot be removed without breaking the seal. The seal includes weakened portions to allow for breaking of the seal into two portions or pieces, which allows for first removal or partial removal of one portion to allow for pivotal movement of the latch to release the hasp, and (when the first portion of the seal has been at least partially removed) allows for removal of the second seal portion, such that the lock body and hasp can be reused with a new seal. The lock body receives and engages the portions of the seal so that, once the seal is broken, such breakage is noticeable and evident to a person viewing the locking device.

The present invention thus overcomes problems with prior art locking devices by providing a disposable seal with at least one non flexible latch engaging element designed to engage with a mating spring loaded movable component or latch within the lock body, which allows the whole seal to be produced in a rigid frangible material. Such rigid construction of the seal and of the lock body and hasp provides the ability to lock or secure the locking device at a structure to physically and mechanically secure the structure.

These and other objects, advantages, purposes and features of the present invention will become apparent upon review of the following specification in conjunction with the drawings.

DESCRIPTION OF THE PREFERRED EMBODIMENTS

Figure 1:
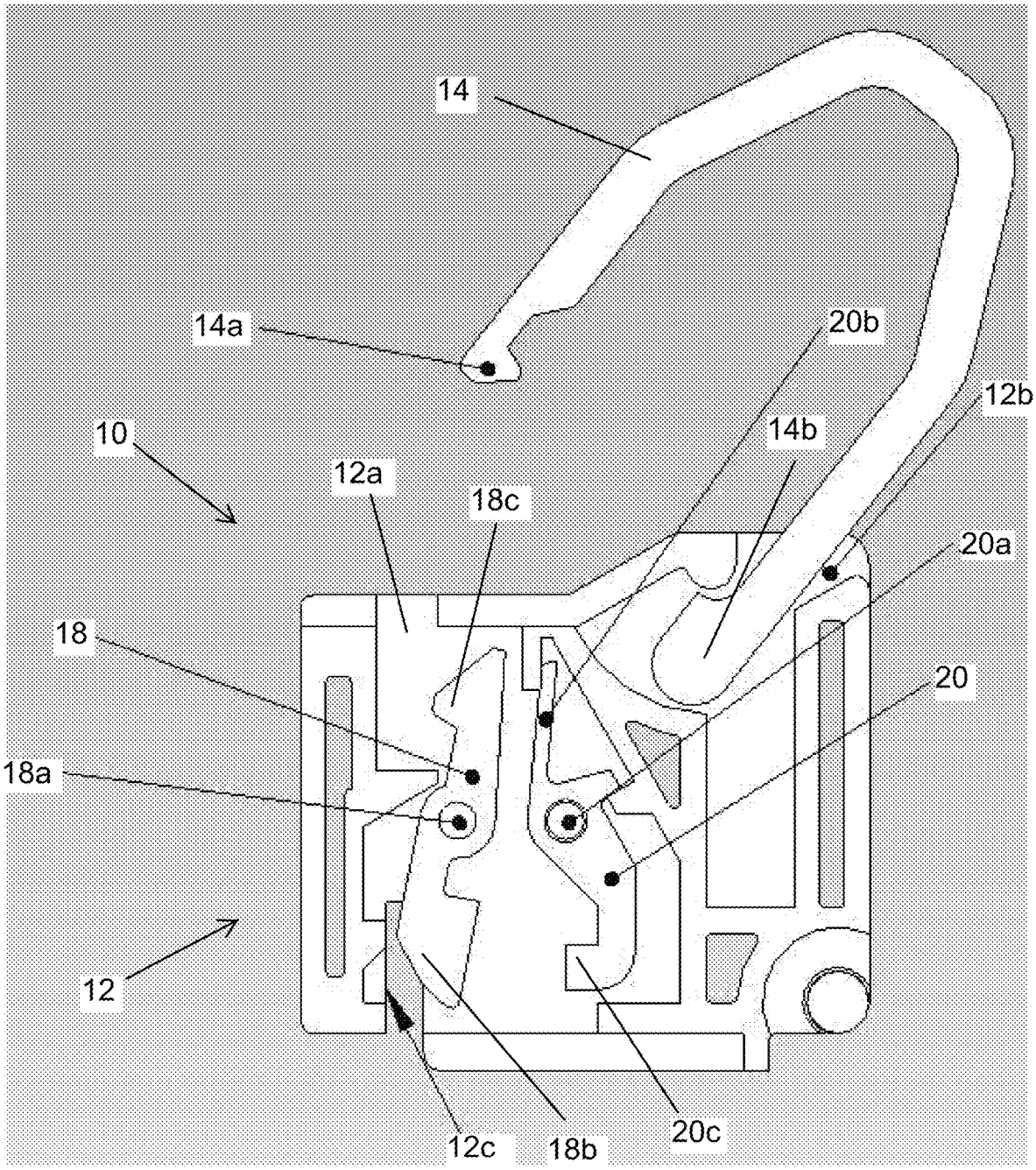
FIG. 1 is a sectional view of a locking mechanism of the present invention, shown with the hasp in an opened position or state.
Figure 2:
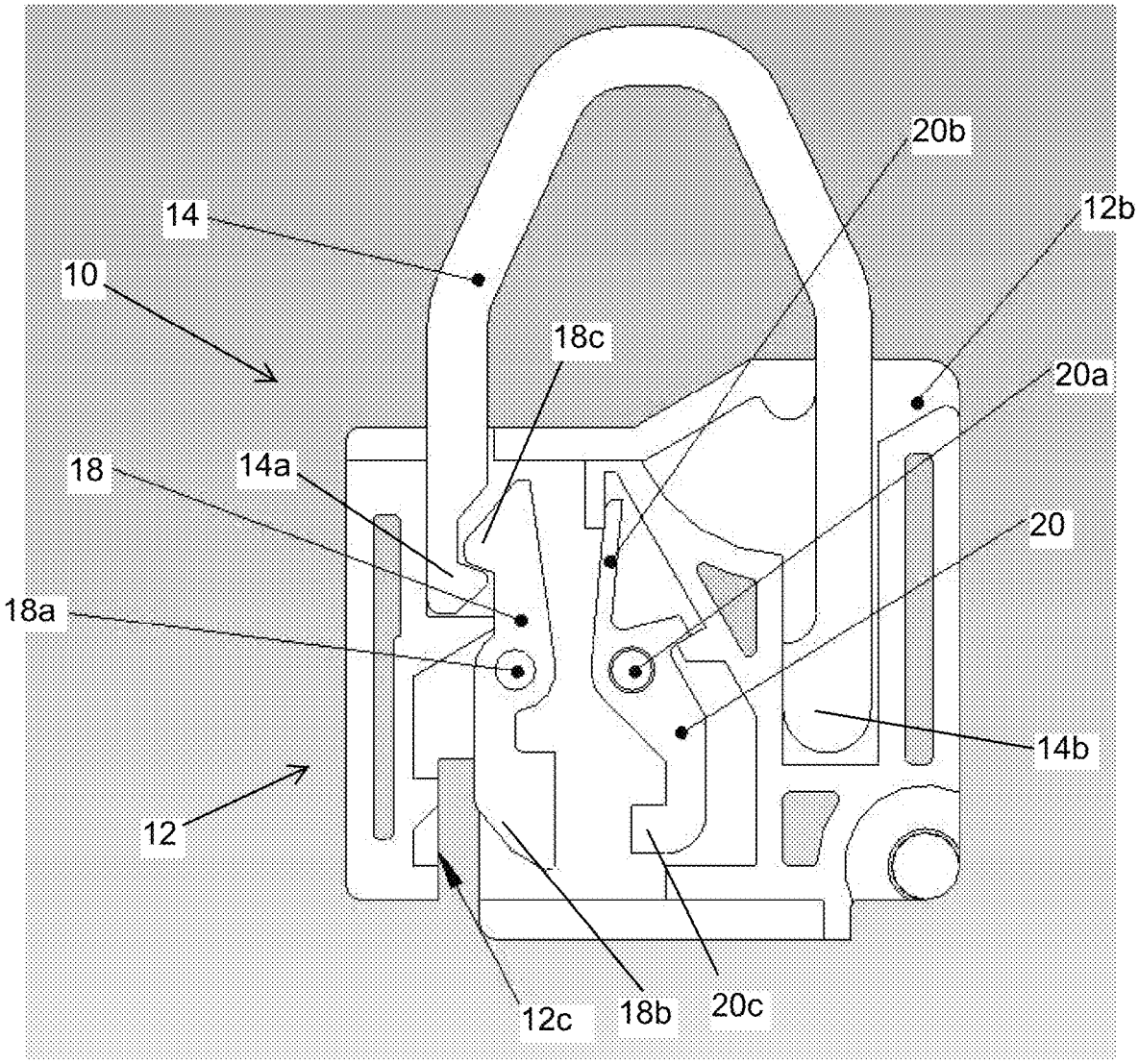
FIG. 2 is another sectional view of the locking mechanism of FIG. 1, shown with the hasp in a closed or locking position or state.
Figure 6:
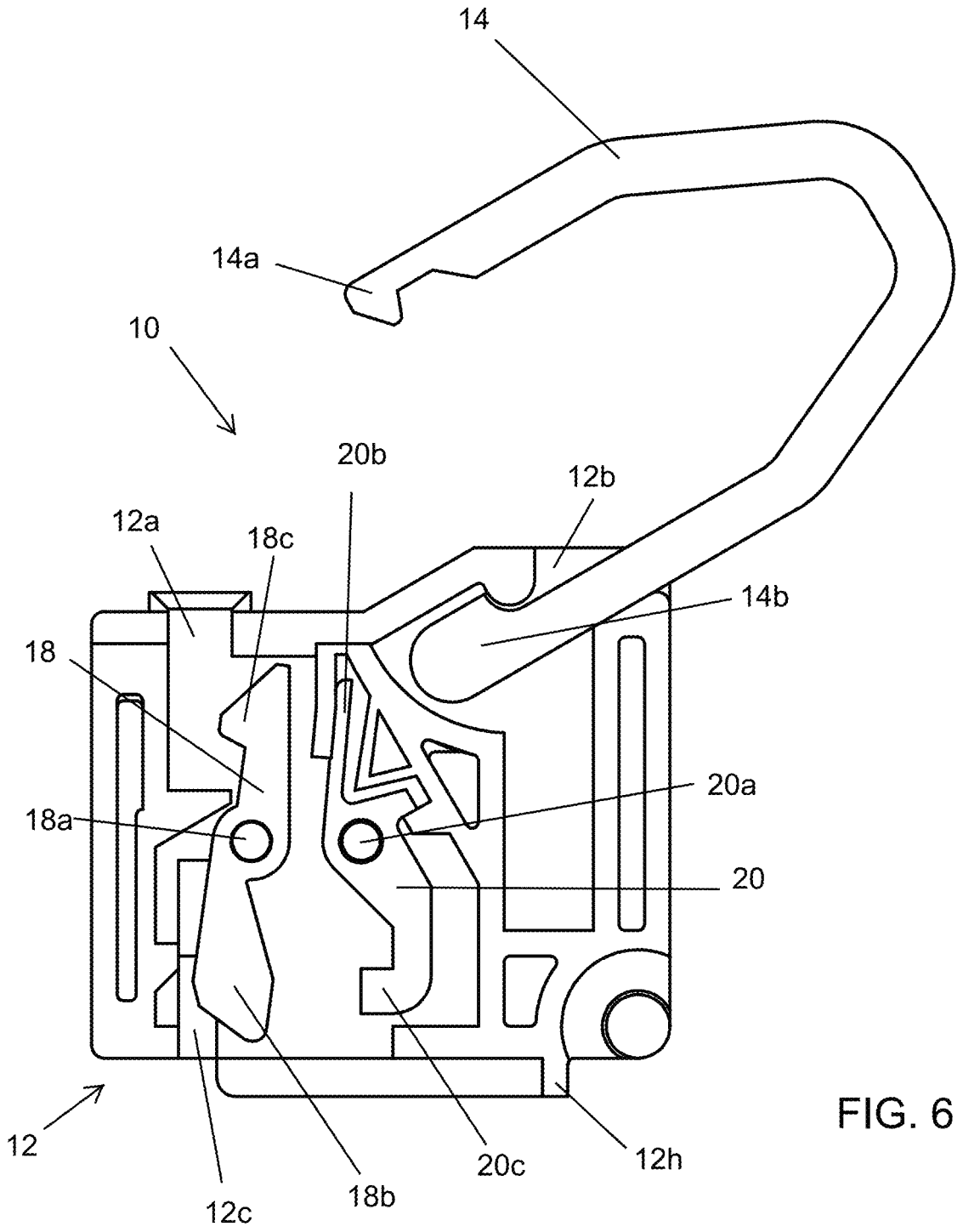
FIG. 6 is another sectional view of the locking mechanism, similar to FIG. 1.
Figure 7:
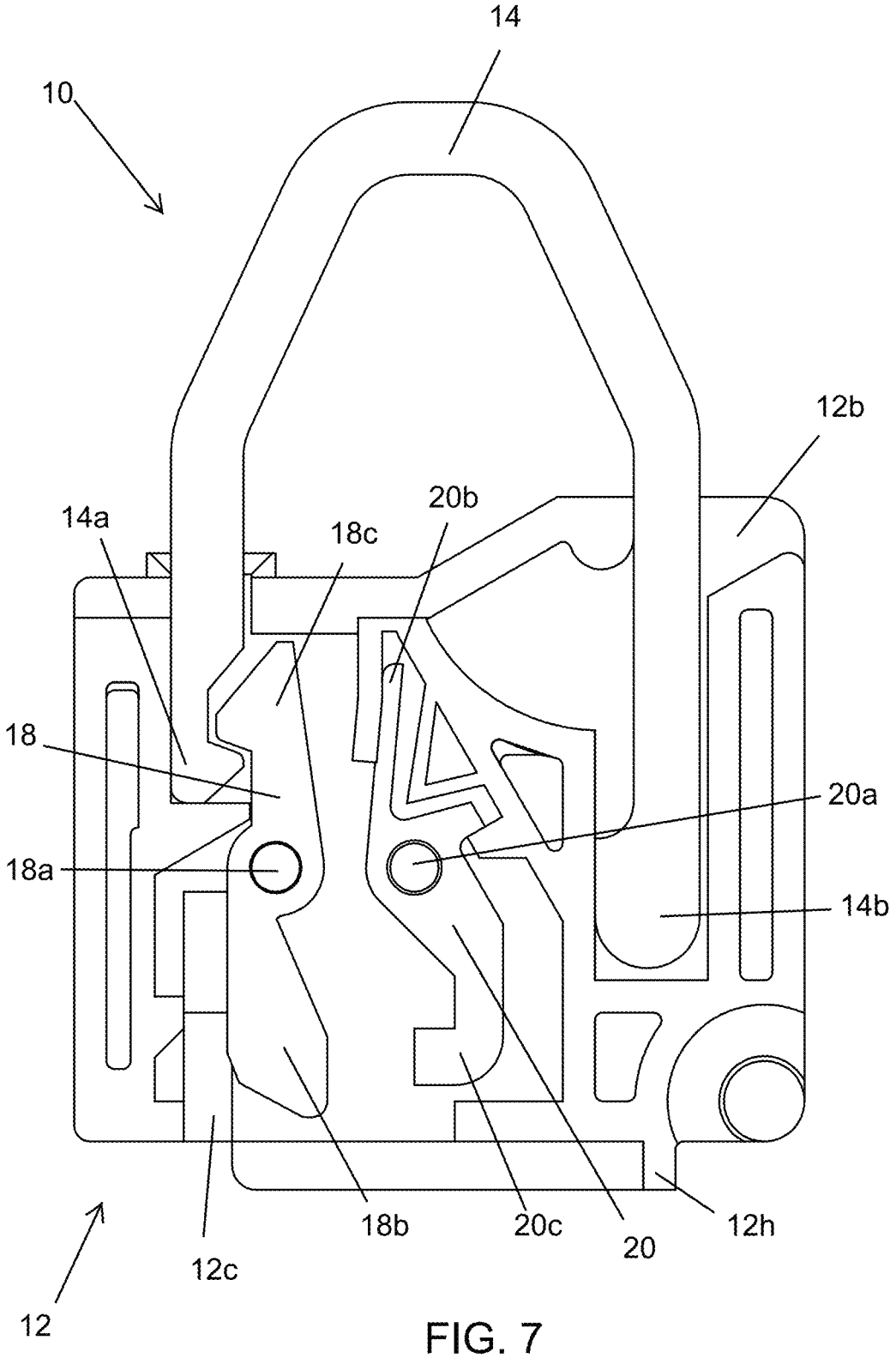
FIG. 7 is another sectional view of the locking mechanism, similar to FIG. 2.

Referring now to the drawings and the illustrative embodiments depicted therein, a locking device or mechanism or security seal 10 includes a lock body 12 and a hasp 14 (FIGS. 1 and 2). The hasp 14, in its open position (FIG. 1), is inserted through the securing fittings or structure attached to the item to be secured, it is then closed with the hasp free end 14*a* inserted into a receiving portion 12*a* of the lock body 12 (see FIG. 2). The hasp 14 includes an attaching end 14*b* that is disposed in another receiving portion 12*b* of the lock body, where the hasp may be moved outwardly from the body and pivoted (such as shown in FIGS. 1 and 6), in order to ease insertion of the hasp into the securing fittings or structure of the item (such as a container, door, box, document case, wallet, airline in-flight cabin cart and/or the like) to which the locking device or mechanism 10 is to be secured (although it is envisioned that the attaching end 14*b* may be longitudinally and pivotally disposed in the receiving portion of the lock body to allow for insertion of the hasp into the securing fittings or structure). After the hasp is inserted into and through the securing fittings, the hasp 14 is pivoted to align the attaching end 14*b* with a channel at the receiving portion 12*b*, whereby the hasp can be pressed towards and into the lock body 12 to engage the free end 14*a* with a lock or latch 18 in the lock body (FIGS. 2 and 7).

In the illustrated embodiment, the lock body 12 houses a hasp locking latch 18 and a spring loaded or biased seal latch 20. The hasp locking latch 18 is pivotally mounted at the lock body 12 and pivots about a pivot axis 18*a*, while the seal latch 20 is also pivotally mounted at the lock body and pivots about a pivot axis 20*a*. As can be seen with reference to FIGS. 1 and 2, the hasp locking latch 18 pivots between an open or receiving position (FIG. 1) and a closed or locking position (FIG. 2) to lock the free end 14*a* of the hasp 14 in the lock body 12 when the locking mechanism is closed. The seal latch 20 is biased or spring loaded via a flexible tab or element 20*b* that engages a tab or element of the lock body, whereby pivotal movement of the latch 20 (such as in the counter-clockwise direction in FIG. 1) causes flexing of element 20*b*, which is biased toward its unflexed state and thus urges the latch 20 back towards its original non-pivoted orientation shown in FIG. 1. The spring or element that urges or biases the latch 20 may comprise a tab or element integral with the latch (such as a plastic latch or flexible metallic latch as illustrated) or the spring or element may comprise a separate metal spring or other flexible or biasing element or component.

Figures 3, 4:
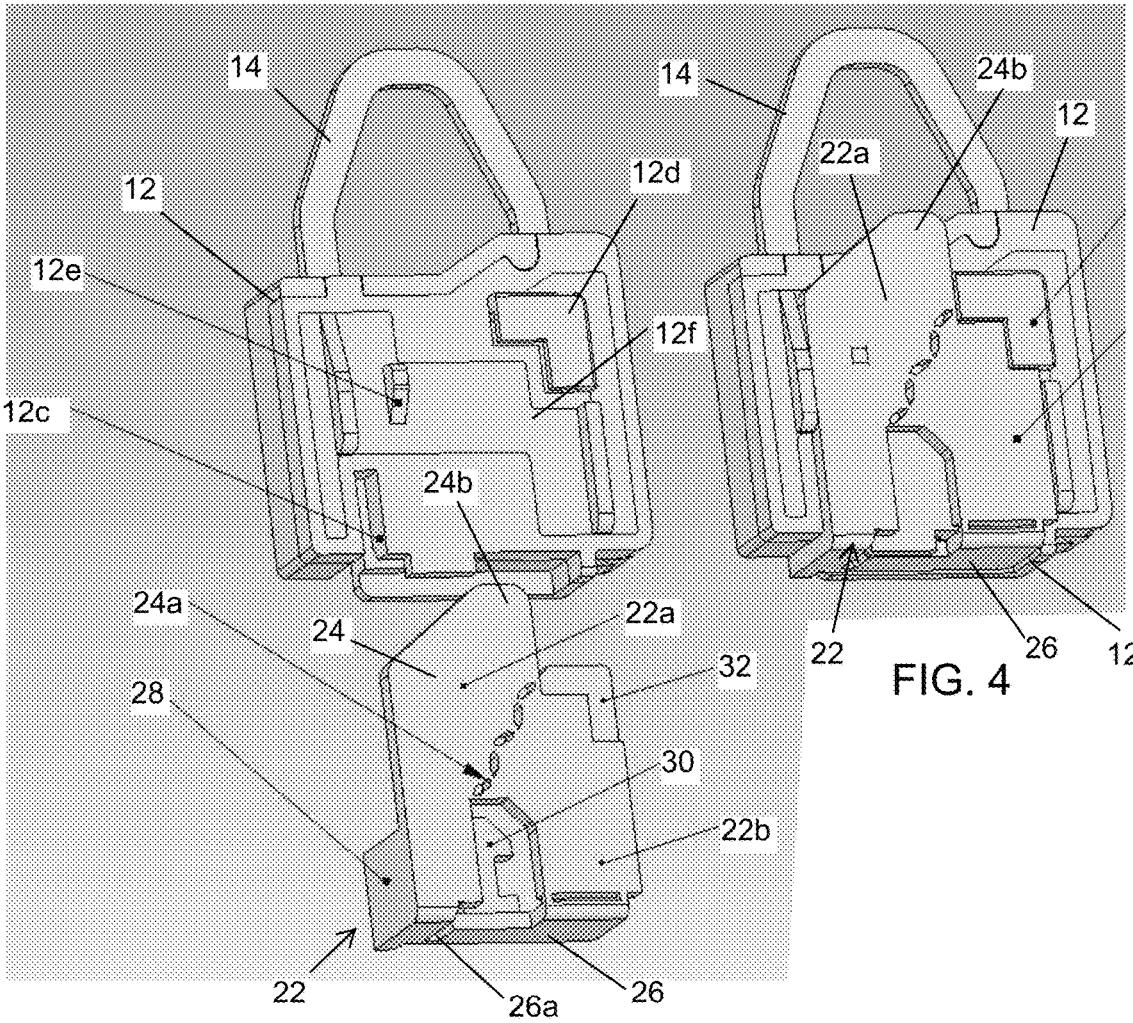
FIG. 3 is an exploded perspective view of the locking mechanism, shown with the seal removed from the lock body.
FIG. 4 is a perspective view of the locking mechanism of FIG. 3, shown with the seal inserted in the lock body.
Figure 8:
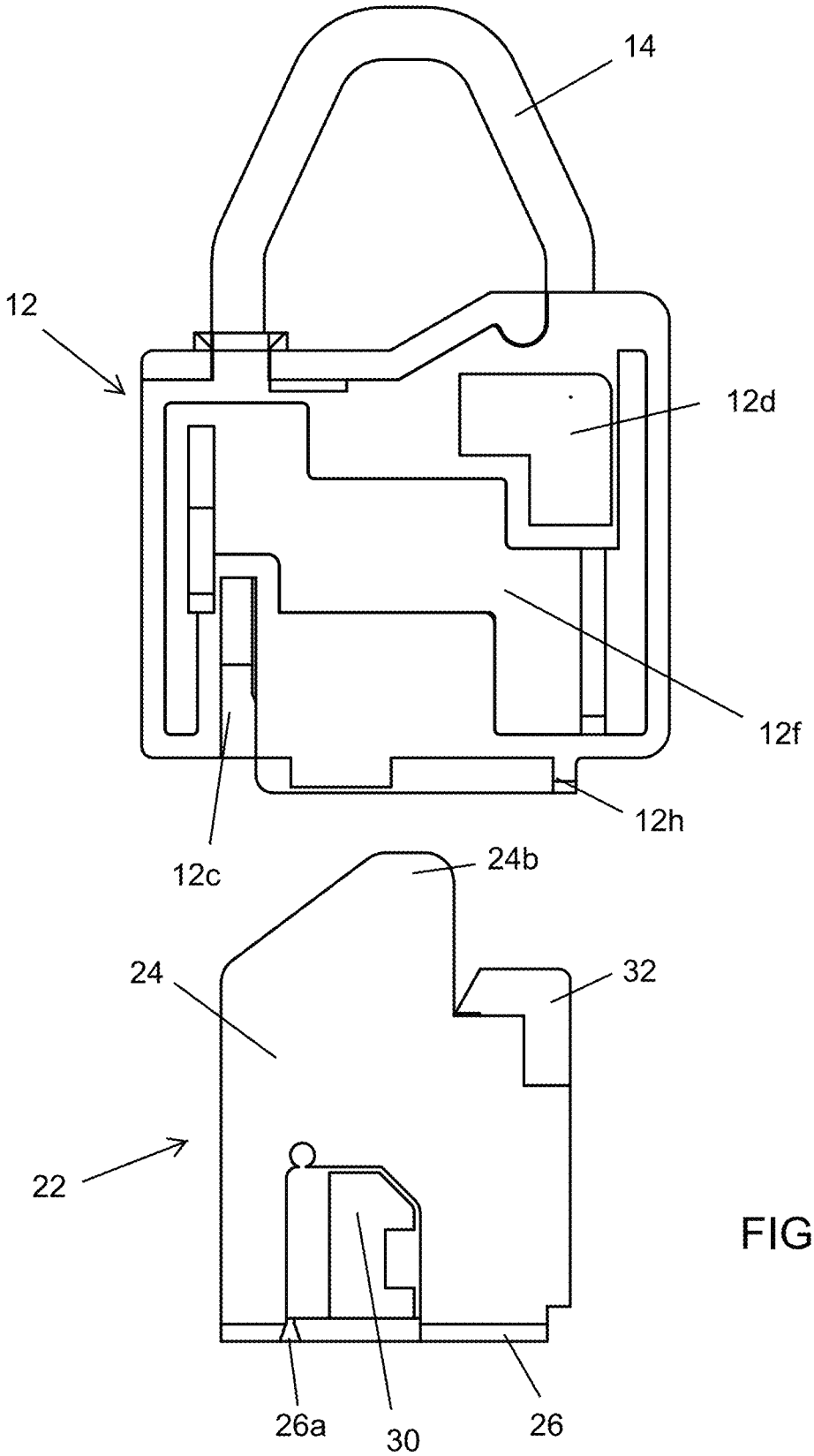
FIG. 8 is a plan view of the lock body, shown with the hasp in its closed or locking position or state, and shown with the seal aligned with the lower region of the lock body similar to what is shown in FIG. 3.
Figure 9:
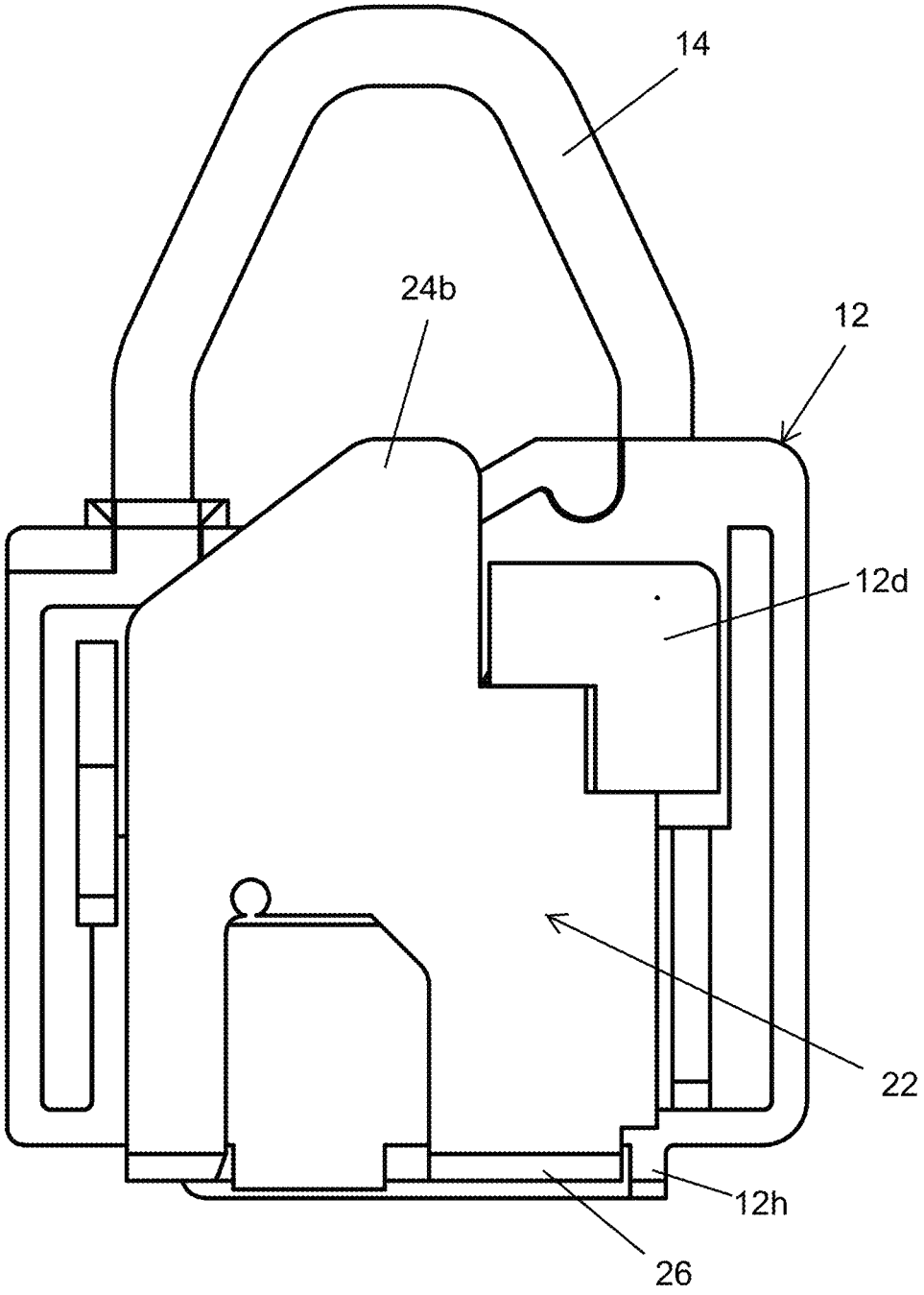
FIG. 9 is a plan view of the locking mechanism, shown with the seal inserted in the lock body.
Figure 10:
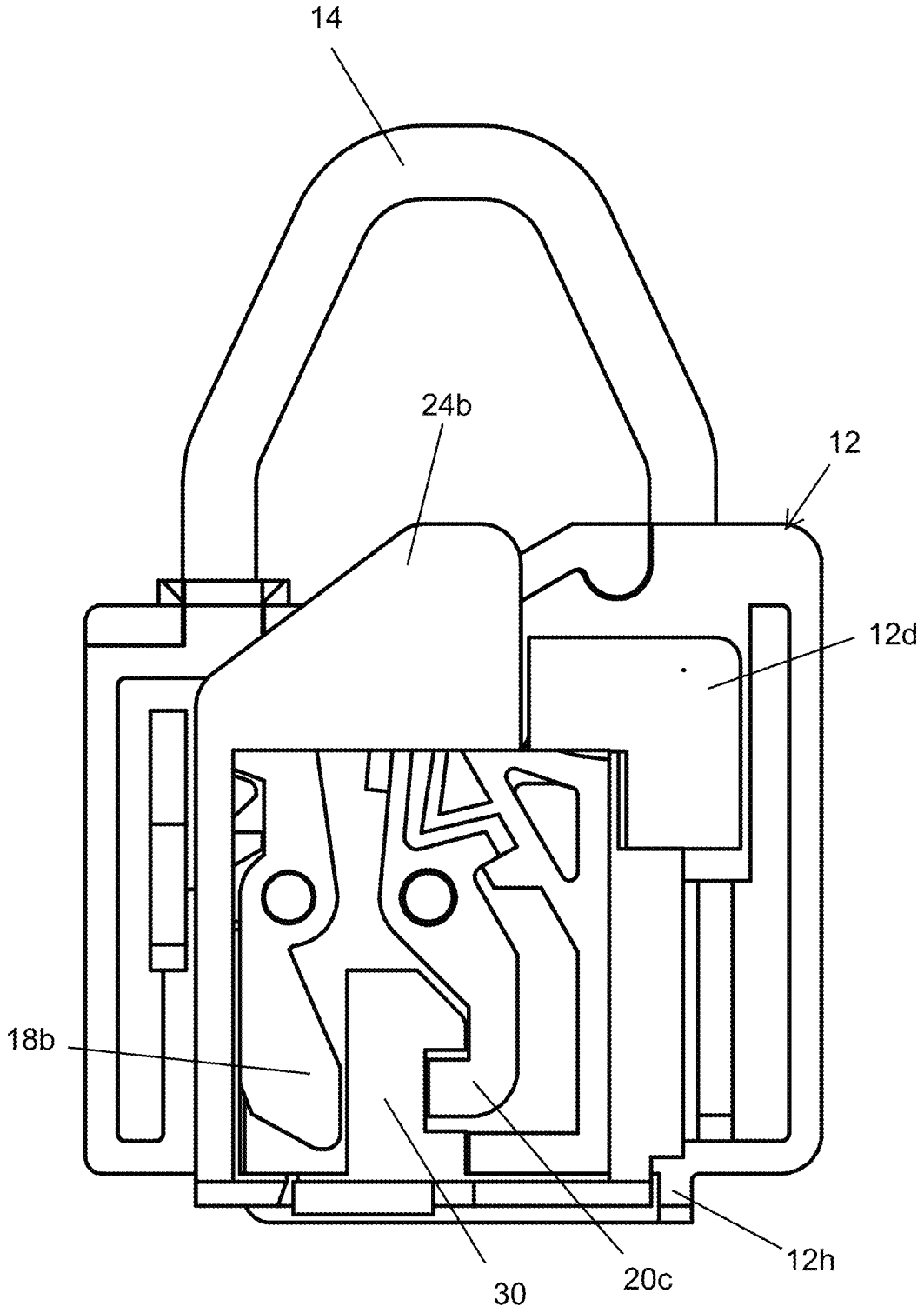
FIG. 10 is a plan view of the locking mechanism similar to FIG. 5, with a portion of the seal cut away and the internal surface or portion of the lock body cut away to reveal the internal locking mechanism in the lock body, showing how the seal is locked in the lock body and the hasp is locked in the lock body, with the latch that retains the hasp being held in place by the seal to preclude removal of the hasp.
Figure 11:
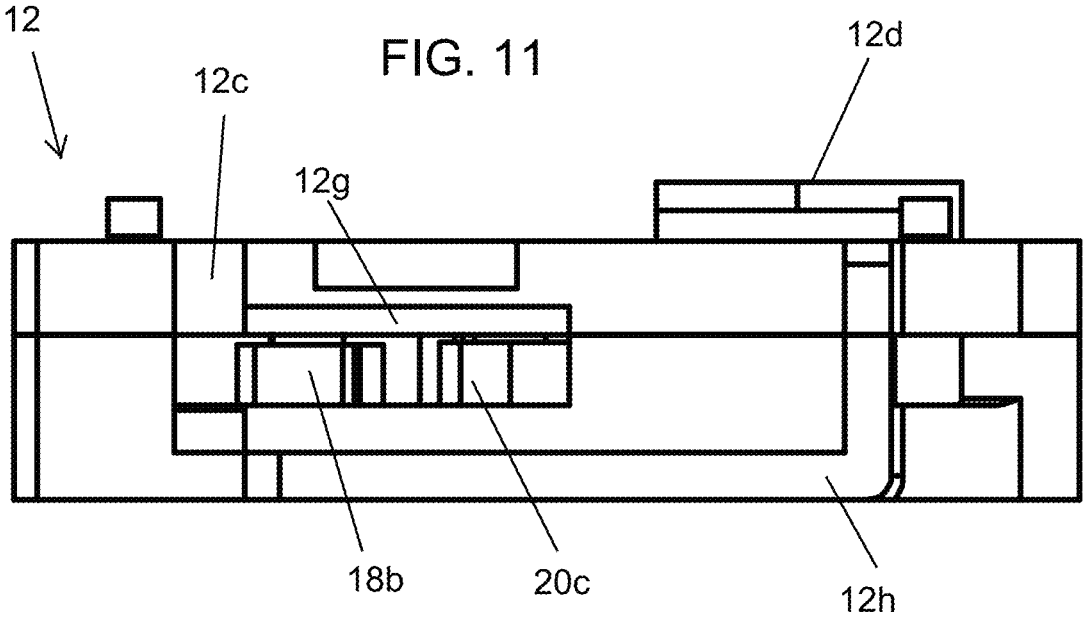
FIG. 11 is a lower view of the lock body, showing the openings for receiving portions of the seal therein.
Figure 12:
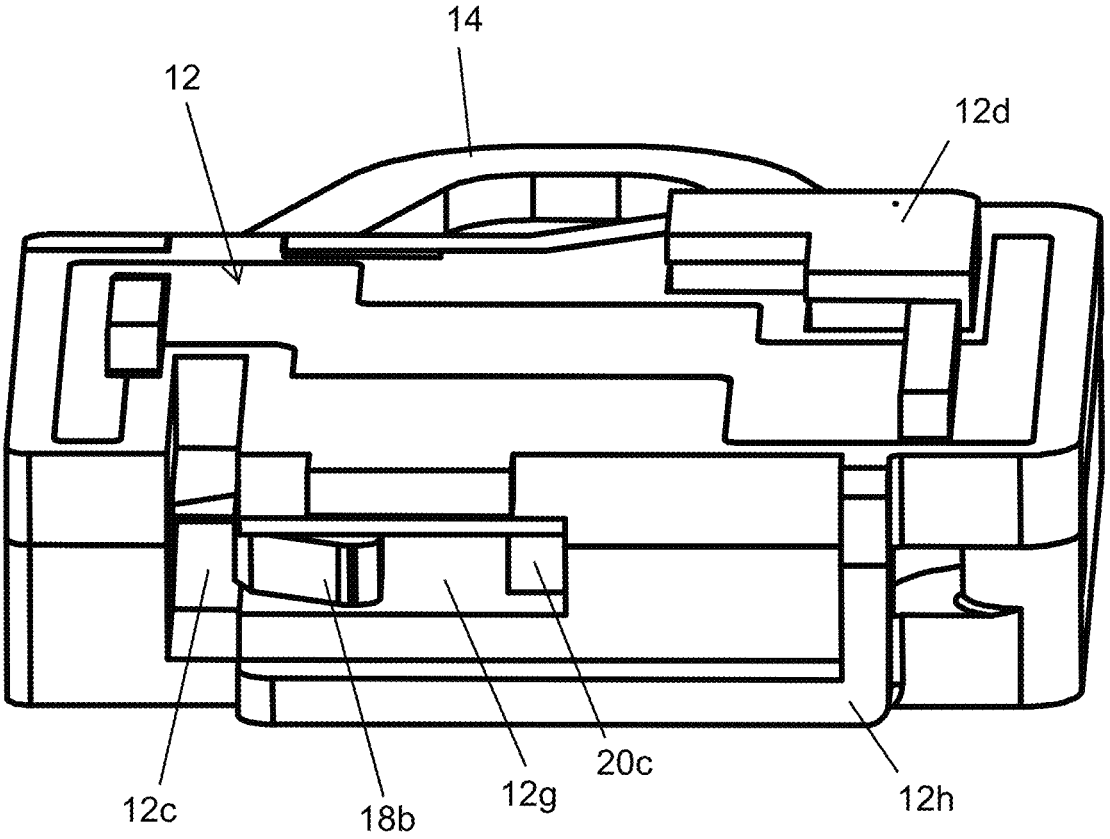
FIG. 12 is a lower perspective view of the lock body of FIG. 11.

The latches 18 and 20 pivot about their respective axes 18*a*, 20*a* when a seal item or element 22 (FIGS. 3-5) is inserted into an aperture or apertures at the base of the body 12. As best shown in FIGS. 3 and 8, the seal 22 comprises a generally planar portion 24 that extends from a base portion 26. The seal 22 further includes a latch engaging element 28 and a latch engaging element 30. The seal portion 24 is inserted into the aperture at the base of the lock body 12, while the latch engaging element 28 of the seal 22 is received in a slot or receiving portion 12*c* of lock body 12 to engage the hasp locking latch 18 and the other latch engaging element 30 of the seal 22 is received in another slot 12*g* in the lock body to engage the seal latch 20. As can be seen with reference to FIGS. 1-5, the latches 18 and 20 are disposed within the lock body, and the elements 28 and 30 are inserted into the respective apertures or slots 12*c*, 12*g* (see FIGS. 11 and 12) at the lock body so as to engage the respective latches within the lock body 12.

Thus, the seal element 22 (see FIG. 3) is inserted into one or more apertures or slots in the base of the lock body 12 so that latch engaging element 28 on the seal 22 engages a portion 18*b* of the hasp locking latch 18, causing the latch 18 within the lock body to rotate about its pivot axis 18*a* so that a locking portion 18*c* of the latch 18 engages and entraps the cut-out free end portion 14*a* of the hasp 14 (when the free end 14*a* of the hasp 14 is inserted into the receiving portion 12*a* of the lock body 12). Likewise, the other latch engaging element 30 of the seal 22 engages a portion 20*c* of the seal latch 20, forcing the spring loaded latch 20 within the lock body to rotate about its pivot axis 20*a* (against the spring force provided by the spring element 20*b*), which allows the portion 20*c* of the latch 20 to move out of the way of the latch engaging element 30 as the seal is inserted into the locking body. When the seal 22 is fully inserted into the lock body 12, the seal latch 20 rotates back under spring pressure to its original position, whereby the portion 20*c* of the latch engages and entraps latch engaging portion 30 of the seal 22. When so engaged and entrapped, the latch engaging portion 30 of the seal 22 precludes retraction of the seal 22 from the lock body.

Thus, when the seal 22 is inserted into the lock body 12, the seal cannot be removed unless it is first broken. It should also be noted that attempts to pull the hasp out of the body will not cause the hasp locking latch 18 to disengage from the free end 14*a* of the hasp 14, as disengaging rotation of the latch 18 (e.g., clockwise rotation of latch 18 in FIG. 2) is prevented by the latch engaging element 28 of the seal 22. The seal comprises a high strength plastic such that the latch engaging element 28 is substantially non-compressible to limit any pivotal movement of the hasp locking latch during an attempt to pull the free end 14*a* of the hasp from the lock body. A high degree of strength would be afforded if the hasp locking latch 18 were to be produced in metal, for example steel.

In the illustrated embodiment, the generally planar portion 24 of the seal 22 includes a weakened or perforated portion 24*a* (weakened via perforations or reduced wall thickness along a line across the generally planar portion) that divides and defines two separable portions 22*a*, 22*b* of the seal (with the latch engaging element 28 being part of one seal portion 22*a* and the latch engaging element 30 being part of the other seal portion 22*b*). The base portion 26 also includes a weakened portion or slot or perforation 26*a* to facilitate breaking of the seal 22 into the two portions 22*a*, 22*b*.

Figure 5:
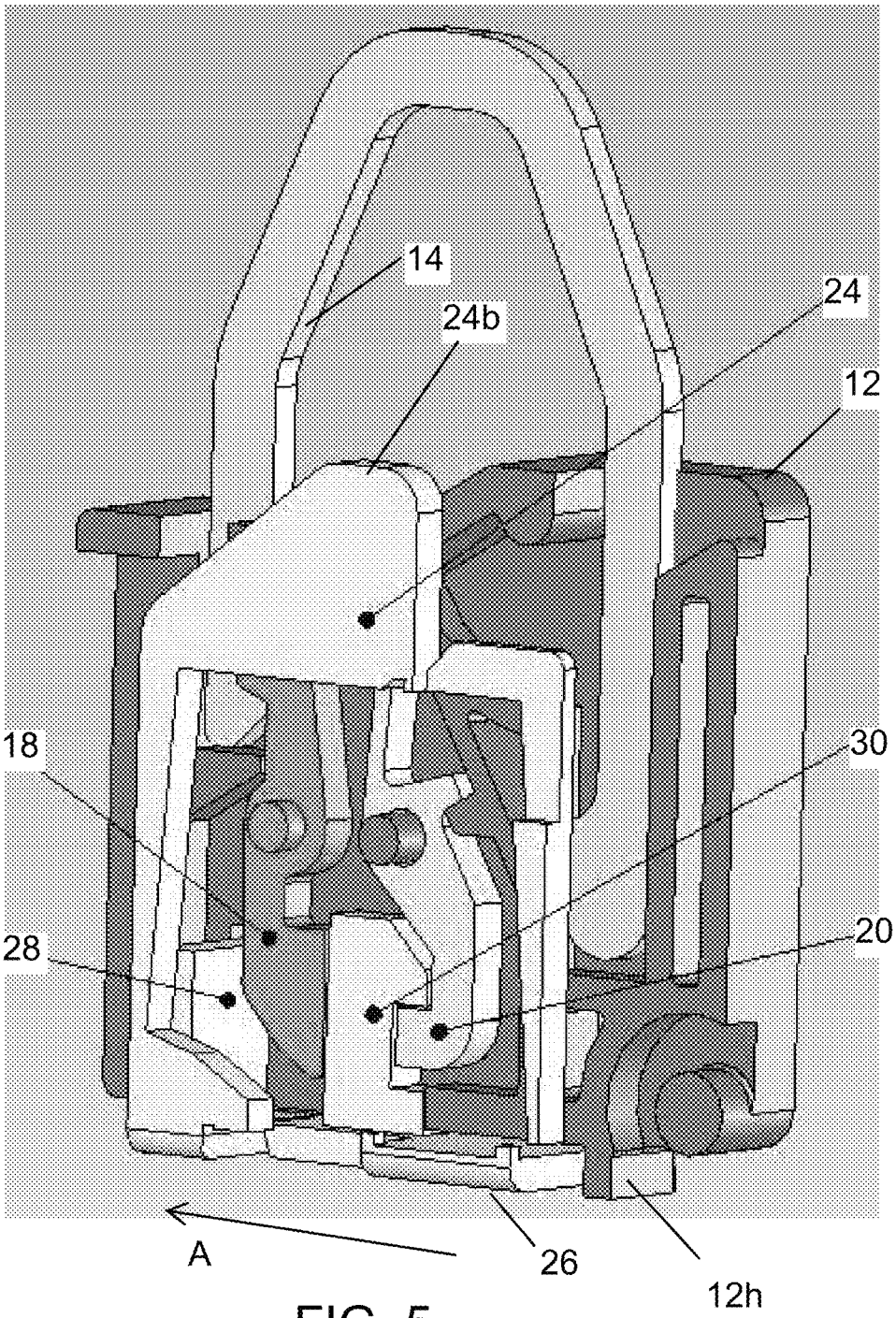
FIG. 5 is another perspective view of the locking mechanism, with a portion of the seal cut away and the internal surface or portion of the lock body cut away to reveal the internal locking mechanism in the lock body, showing how the seal is locked in the lock body and the hasp is locked in the lock body, with the latch that retains the hasp being held in place by the seal to preclude removal of the hasp.

Thus, in order to remove the seal 22 from the lock body 12, the seal portion 22*a* of the seal is pulled away from the lock body causing the weakened region or points indicated at 24*a* to fracture cleanly. The seal may be fractured or broken by a user pressing an exposed portion or tab 24*b* (which may protrude through an aperture in the locking body as can be seen in FIG. 5, such as at an upper end region of the locking body opposite the lower or base region of the body where the seal is inserted) of the planar portion 24 of the seal to cause movement of the seal portion 22*a* relative to the seal portion 22*b* (which may be held in place relative to the lock body via a receiving portion 12*d* at the lock body, as discussed below), so as to fracture the seal along the weakened region 24*a*. When the seal has been fractured, the seal portion 22*a* can be removed (to allow latch 18 to pivot to release the hasp), while leaving the seal portion 22*b* still in place in the lock body 12.

After the weakened portions are broken, the seal portion 22*a* may be removed totally from the lock body, or at least far enough for element 28 to move out from the lock body to disengage from the portion 18*b* of the hasp locking latch 18. For example, the seal portion 22*a* may be twisted so the portion of the seal portion 22*a* along the weakened region is between the portion 22*b* and the interior surface 12*f* of the lock body at least until the element 28 is moved downward past the latch 18. If it is desired to fully remove the seal portion 22*a* before removal of the seal portion 22*b*, the dimensions of the lock body cavity and seal portions may be designed to provide a retraction path of the seal portion 22*a* out of the lock body after the weakened portions have been broken.

When the seal portion 22*a* is moved sufficiently outward from the lock body, the portion 18*b* can be pivoted or moved to pivot the latch 18 to disengage the portion 18*c* of the latch from the hasp and to move the portion 18*b* of the latch away from the latch engaging element 30 of the seal. When the portion 18*b* of the latch 18 is moved away from the latch engaging element 30, the latch engaging element 30 of the seal 22 (along with the rest of the second seal portion 22*b*) is free to move relative to the lock body 12 (such as in the direction of arrow 'A' in FIG. 5) so as to move the latch engaging portion 30 away from and out of entrapment with portion 20*c* of the seal latch 20, allowing for total removal of the seal 22 from the lock body.

Optionally, and desirably, the locking device includes a tamper evident feature that makes it so that a person viewing the locking device can readily determine that the seal has been fractured (even though the seal, in use, would be substantially within a housing of the locking device and not viewable). For example, and with reference to FIGS. 3 and 4, the lock body 12 may include a raised portion or element or receiving portion 12*d* at its interior surface 12*f* that is configured to receive and entrap a tab or element 32 of the seal portion 22*b* of the seal 22 to retain the seal portion 22*b* of the seal 22 when the seal portion 22*a* is urged in a direction generally normal to the plane of the planar portion and broken from or separated from seal portion 22*b* and at least partially removed from the lock body. As can be seen with reference to FIGS. 3 and 4, the tab element 32 is offset from the rest of the seal portion 22*b* and is received within or under the receiving portion 12*d*. A projection 12*e* protrudes from the surface 12*f* of the lock body 12 and is designed to provide a small amount of pressure to the underside of the seal portion 22*a* (generally normal to the plane of the seal portion) when the seal 22 is inserted into the lock body. Thus, when the seal 22 is broken (along weakened or frangible region 24*a*) and the seal portion 22*a* is removed (such as to temporarily unlock the locking device) and then re-inserted back into the lock body, the pressure applied to seal portion 22*a* by the projection 12*e* precludes the seal portion 22*a* from aligning with seal portion 22*b* and thus ensures that attempts to break the seal and later realign the two seal portions 22*a*, 22*b* of the broken seal cannot be invisibly achieved.

Figure 13:
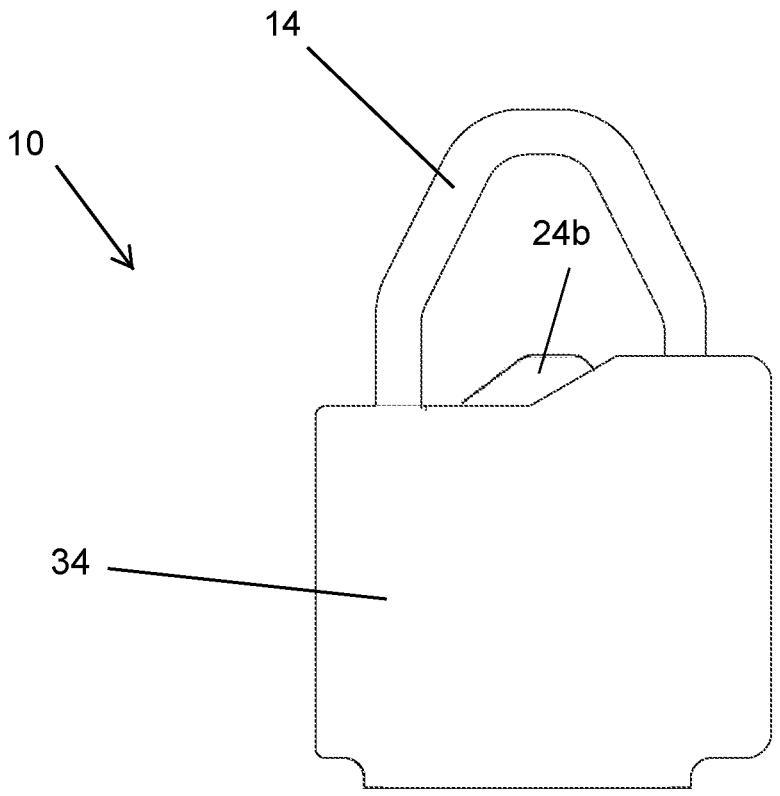
FIG. 13 is a plan view of the locking device, with a housing that at least partially encases the lock body.

During use, the locking device may (in its open state) be positioned at a structure to be secured, and the free end of the hasp may be inserted through the structure and inserted into the receiving portion 12*a* of the lock body. The hasp may be pressed into the lock body to the closed state, and the seal may then be inserted into the aperture at the base of the lock body. When the seal is inserted into the lock body, the seal element or tab 28 engages the latch 18 to pivot the latch to engage and secure the hasp in the closed position, while the seal element or tab 30 engages the latch 20 to pivot the latch during insertion of the seal, whereby the latch 20, when the seal is fully inserted, pivots back to its initial position to lock the seal in the lock body. Also, when the seal is fully inserted into the slots of the lock body, the base 26 of the seal nests in a receiving portion at the bottom of the lock body that is partially circumscribed or formed by a wall 12*h* of the lock body. Although the locking device is illustrated with the seal exposed (in FIGS. 4 and 5), in use the locking device will include a housing portion 34 (FIG. 13) that encompasses or encases the lock body and seal, such that the only portions of the seal that are exposed are the base portion 26 and the tab 24*b*.

If the locking device is tampered with, the seal will break along the frangible portion(s), whereby one seal portion is movable or retractable to allow for pivoting of the hasp locking latch 18 to disengage or unlock the hasp. When the one seal portion is sufficiently moved, the other seal portion can be moved to disengage the seal latch 20 to allow for removal of the other seal portion from the lock body. If a person tries to reassemble the seal after breaking it, the lock body includes means for misaligning the seal portions after they are broken apart, such that any tampering with the locking device is readily apparent or evident.

Therefore, the present invention provides a locking device that includes a rigid padlock type locking body (such as a metallic locking body or other rigid material) and a rigid hasp (such as a metallic hasp or other rigid material) that is locked at the locking body via a pivotable rigid latch (such as a metallic latch or other rigid material). The locking device includes a one piece seal produced of a rigid material (such as a frangible rigid material, such as an engineered plastic or the like) that incorporates at least one non-flexible latch engaging element that is configured to engage with a spring loaded latch within the padlock type body.

Thus, when the seal is inserted into the lock body, the seal cannot be removed without first breaking the seal. The seal includes one or more frangible or weakened or perforated regions or points separating two parts of the seal, with one part remaining in place (and secured in place) in the locking body until the other is removed or partially removed. The rigid latch within the lock body engages and entraps the hasp when the seal is inserted and cannot release from the hatch until the seal has been broken and a portion of the seal at least partially removed from the lock body. An element forming part of the seal prevents the hasp entrapping latch from movement until at least one portion of the seal is removed or partially removed. Another element also precludes alignment of the seal portions (once broken) so that any tampering or breaking of the seal element is readily visible.

Changes and modifications to the specifically described embodiments may be carried out without departing from the principles of the present invention, which is intended to be limited only by the scope of the appended claims as interpreted according to the principles of patent law.

The invention claimed is:

1. A locking device comprising:

a lock body, wherein the lock body comprises a hasp locking latch disposed therein and a seal locking latch disposed therein;

a hasp movably disposed at the lock body and movable between an open state, where a free end of the hasp is external the lock body, and a closed state, where the free end of the hasp is within the lock body;

a seal configured to be inserted into the lock body, wherein the seal, when inserted into the lock body when the hasp is in its closed state, engages the hasp locking latch to move the hasp locking latch to engage and lock the hasp in its closed state;

wherein the hasp locking latch is pivotally disposed in the lock body and pivots to engage and lock the hasp in its closed state;

wherein the seal locking latch is pivotally disposed in the lock body and pivots to engage the seal when the seal is inserted into the lock body to lock the seal within the lock body; and wherein the seal comprises a rigid material and wherein the seal includes a frangible portion that is configured to break the seal into first and second portions.

2. The locking device of claim 1, wherein the seal locking latch is biased towards an initial state and is pivoted away from its initial state during insertion of the seal and pivots back to its initial state after insertion of the seal to engage the seal to lock the seal within the lock body.

3. The locking device of claim 1, wherein the lock body comprises a metallic material.

4. The locking device of claim 1, wherein the hasp locking latch comprises a metallic material.

5. The locking device of claim 1, wherein the hasp comprises a metallic material.

6. The locking device of claim 1, comprising a housing that at least partially encases the lock body and the seal when the seal is inserted into the lock body.

7. The locking device of claim 1, wherein the frangible portion of the seal comprises perforations of the seal between along an interface of the first portion and the second portion.

8. The locking device of claim 7, wherein the seal includes an upper tab that protrudes from the lock body when the seal is disposed therein, and wherein the upper tab provides a portion of the seal that allows a user to press at to break the seal along the frangible portion.

9. The locking device of claim 7, wherein the frangible portion of the seal comprises a notch at a base portion of the seal that enhances breaking of the base portion when the perforations of seal are broken.

10. The locking device of claim 1, wherein the seal includes a latch engaging element that, when the seal is locked within the lock body, engages the hasp locking latch and precludes pivoting of the hasp locking latch toward a releasing position that allows for movement of the hasp toward its open state.

11. The locking device of claim 1, wherein the seal includes a latch engaging element that, when the seal is locked within the lock body, is engaged by the seal locking latch and precludes pivoting of the seal locking latch toward a releasing position that allows for retraction of the seal from the lock body.

12. A locking device comprising:

a lock body, wherein the lock body comprises a hasp locking latch disposed therein and a seal locking latch disposed therein;

a hasp movably disposed at the lock body and movable between an open state, where a free end of the hasp is external the lock body, and a closed state, where the free end of the hasp is within the lock body;

a seal configured to be inserted into the lock body, wherein the seal, when inserted into the lock body when the hasp is in its closed state, engages the hasp locking latch to move the hasp locking latch to engage and lock the hasp in its closed state;

wherein the seal locking latch is movably disposed in the lock body and moves to engage the seal when the seal is inserted into the lock body to lock the seal within the lock body;

wherein the seal comprises a rigid material and wherein the seal includes a frangible portion that is configured to break the seal into first and second portions; and wherein the first portion of the seal engages the hasp locking latch and the second portion of the seal engages the seal locking latch.

13. The locking device of claim 12, wherein the seal locking latch is biased towards an initial state and is moved away from its initial state during insertion of the seal and moves back to its initial state after insertion of the seal to engage the seal to lock the seal within the lock body.

14. The locking device of claim 12, wherein, when the seal is within the lock body and in its unbroken state, the first portion of the seal precludes movement of the hasp locking latch in a releasing direction that would unlock the hasp.

15. The locking device of claim 14, wherein, when the seal is within the lock body and in its unbroken state, the second portion of the seal and the seal locking latch preclude removal of the seal when the seal is in its unbroken state.

16. The locking device of claim 15, wherein, when the frangible portion is broken to break the seal into the first and second portions, the first portion of the seal is moved relative to the second portion of the seal and is at least partially removed from the lock body to allow for movement of the hasp locking latch to unlock the hasp.

17. A locking device comprising:

a lock body, wherein the lock body comprises a hasp locking latch disposed therein and a seal locking latch disposed therein;

a hasp movably disposed at the lock body and movable between an open state, where a free end of the hasp is external the lock body, and a closed state, where the free end of the hasp is within the lock body;

a seal configured to be inserted into the lock body, wherein the seal, when inserted into the lock body when the hasp is in its closed state, engages the hasp locking latch to move the hasp locking latch to engage and lock the hasp in its closed state;

wherein the seal locking latch is movably disposed in the lock body and moves to engage the seal when the seal is inserted into the lock body to lock the seal within the lock body;

wherein the seal comprises a rigid material and wherein the seal includes a frangible portion that is configured to break the seal into first and second portions; and wherein the lock body comprises a protrusion that engages the first portion of the seal such that the first and second portions of the seal are misaligned by urging of the first portion away from the second portion when the frangible portion of the seal is broken.

18. The locking device of claim 17, wherein the lock body comprises a receiving portion that partially receives the second portion of the seal, and wherein the protrusion and the receiving portion cooperate to misalign the first and second portions of the seal if the frangible portion of the seal is broken.

19. A locking device comprising:

a lock body, wherein the lock body comprises a hasp locking latch disposed therein and a seal locking latch disposed therein;

a hasp movably disposed at the lock body and movable between an open state, where a free end of the hasp is external the lock body, and a closed state, where the free end of the hasp is within the lock body;

a seal configured to be inserted into the lock body, wherein the seal comprises a first latch engaging element and a second latch engaging element, and wherein the seal comprises a plastic material and wherein the seal includes a frangible portion that is configured to break the seal into first and second portions;

wherein the first latch engaging element is part of the first portion and the second latch engaging element is part of the second portion;

wherein the lock body comprises first and second apertures at an end thereof;

wherein, when the seal is inserted into the lock body when the hasp is in its closed state, the first latch engaging element is received in the first aperture and engages the hasp locking latch to move the hasp locking latch to engage and lock the hasp in its closed state; and wherein, when the seal is inserted into the lock body when the hasp is in its closed state, the second latch engaging element is received in the second aperture and the seal locking latch moves to engage the second latch engaging element to lock the seal within the lock body.

20. The locking device of claim 19, wherein, when the frangible portion is broken, the first portion is movable relative to the second portion and is partially retractable from the lock body such that the first latch engaging element at least partially disengages from the hasp locking latch.

21. The locking device of claim 19, wherein, when the frangible portion is broken, the second portion is movable relative to the first portion and is partially retractable from the lock body such that the second latch engaging element at least partially disengages from the seal locking latch.

22. The locking device of claim 19, wherein the seal locking latch is biased towards engagement with the second latch engaging element so as to move to engage the second latch engaging element when the seal is inserted into the lock body.

23. The locking device of claim 19, wherein the seal locking latch is biased towards an initial state and is pivoted away from its initial state during insertion of the seal and pivots back to its initial state after insertion of the seal to lock the seal within the lock body.

24. The locking device of claim 19, wherein the lock body comprises a metallic material, and wherein the hasp locking latch comprises a metallic material, and wherein the hasp comprises a metallic material.

25. The locking device of claim 19, wherein the lock body comprises a protrusion that engages the first portion of the seal such that the first and second portions of the seal are misaligned by urging of the first portion away from the second portion when the frangible portion of the seal is broken.

26. The locking device of claim 19, comprising a housing that at least partially encases the lock body and the seal when the seal is inserted into the lock body.

* * * * *